US009590338B1

(12) United States Patent
Schmitt et al.

(10) Patent No.: US 9,590,338 B1
(45) Date of Patent: Mar. 7, 2017

(54) RIGID-FLEX CIRCUIT CONNECTOR

(71) Applicant: TYCO ELECTRONICS CORPORATION, Berwyn, PA (US)

(72) Inventors: Matthew Ryan Schmitt, Middletown, PA (US); Linda Ellen Shields, Camp Hill, PA (US); Randall R. Henry, Harrisburg, PA (US); Sandeep Patel, Middletown, PA (US); Mailoan Tran, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 14/954,045

(22) Filed: Nov. 30, 2015

(51) Int. Cl.
*H01R 12/00* (2006.01)
*H01R 12/79* (2011.01)

(52) U.S. Cl.
CPC ..... *H01R 12/79* (2013.01)

(58) Field of Classification Search
CPC ..... H01R 12/59
USPC ..... 439/67, 65, 82, 781
See application file for complete search history.

(56) References Cited

U.S. PATENT DOCUMENTS 6,971,887 B1 12/2005 Trobough
8,188,594 B2 * 5/2012 Ganesan ..... H01L 23/367 257/675
8,708,729 B2 * 4/2014 An ..... H01R 12/79 439/331
8,867,231 B2 * 10/2014 Roitberg ..... H01L 23/50 361/729
2016/0056554 A1 * 2/2016 Costello ..... H01R 12/7076 439/65

* cited by examiner

*Primary Examiner* — Phuong Dinh

(57) ABSTRACT

A rigid-flex circuit connector is provided that includes a layered circuit board and an array of electrical contacts. The layered circuit board has a rigid board stacked above a flex board. The rigid board includes at least one rigid substrate and a rigid board circuit. The rigid board circuit includes a plurality of conductive vias extending into the rigid board from a top surface of the rigid board. The flex board includes at least one flexible substrate and a flex board circuit. The flex board circuit electrically connects to the conductive vias of the rigid board circuit. The array of electrical contacts is loaded in the conductive vias. The electrical contacts have mating ends that protrude from the top surface of the rigid board to mechanically engage and electrically connect to mating contacts of a mating electronic component.

20 Claims, 4 Drawing Sheets

RIGID-FLEX CIRCUIT CONNECTOR

BACKGROUND OF THE INVENTION

The subject matter herein relates generally to connector systems with rigid-flex circuit connectors.

Some known connectors are used to route high speed signals from an electronic component, such as a microprocessor or other processing unit, along a conductive path to input/output (I/O) connector, for example. One option is to route data signals through a motherboard or other printed circuit board (PCB) to which the microprocessor is mounted. However, as data speeds and the density of electronics on a motherboard increase, routing high speed signals through the motherboard may result in a reduced signal transfer performance as compared to routing the high speed signals along another signal path that is separate from the motherboard. For example, the motherboard may transmit data signals slower and/or with more signal degradation than an auxiliary circuit device, such as a flex film, a flex PCB, or a rigid PCB.

Current technology uses multiple connection interfaces to form such a conductive path from a microprocessor, for example, through an auxiliary circuit device. Contact portions of the microprocessor may engage electrical contacts held in a housing or socket, where the electrical contacts engage the microprocessor along a top side of the housing. An opposite bottom side of the housing may include a ball grid array that electrically connects the electrical contacts to the auxiliary circuit device, which extends between the housing and the I/O connector, for example, at the distal end of the conductive signal path. The ball grid array is an array of solder balls that are soldered to electrical conductors of the auxiliary circuit device. Ball grid arrays have known manufacturing and signal integrity issues. For example, from a manufacturing standpoint it is difficult to align the solder balls with both the electrical contacts in the housing and the electrical conductors of the auxiliary circuit device, and to maintain the solder balls in proper alignment during the soldering process. The solder balls may be prone to melting at different rates and into different shapes. For example, one solder ball that is flatter in shape than another solder ball may risk formation of a gap between the solder ball and either the housing or the auxiliary circuit device, such that the solder ball fails to form a conductive path between the corresponding electrical contact and electrical conductor. Moreover, from a signal integrity standpoint, the solder balls introduce an impedance discontinuity along the conductive signal path since the solder balls may have significantly different impedance and/or other characteristics relative to the electrical contacts in the housing and/or the electrical conductors in the auxiliary circuit device. The impedance discontinuity may cause attenuation, standing waves, distortion, and the like since a portion of the signals may be reflected back towards the source.

BRIEF DESCRIPTION OF THE INVENTION

In an embodiment, a rigid-flex circuit connector is provided that includes a layered circuit board and an array of electrical contacts. The layered circuit board has a rigid board stacked above a flex board. The rigid board includes at least one rigid substrate and a rigid board circuit. The rigid board circuit includes a plurality of conductive vias extending into the rigid board from a top surface of the rigid board. The flex board includes at least one flexible substrate and a flex board circuit. The flex board circuit electrically connects to the conductive vias of the rigid board circuit. The array of electrical contacts is loaded in the conductive vias. The electrical contacts have mating ends that protrude from the top surface of the rigid board to mechanically engage and electrically connect to mating contacts of a mating electronic component.

In another embodiment, a rigid-flex circuit connector includes a layered circuit board and an array of electrical contacts. The layered circuit board has a rigid portion and a flexible portion extending from the rigid portion to a distal end. The layered circuit board includes a rigid board stacked above a flex board. The rigid portion includes both the rigid board and the flex board. The flexible portion includes the flex board and not the rigid board. The flex board includes at least one flexible substrate and a flex board circuit. The flex board circuit includes a conductive layer that extends from the rigid portion along the flexible portion towards the distal end. The rigid board includes at least one rigid substrate and a rigid board circuit. The rigid board circuit including a plurality of conductive vias extending into the rigid board from a top surface of the rigid board. The conductive vias of the rigid board circuit electrically connect to the conductive layer of the flex board circuit. The array of electrical contacts is loaded in the conductive vias. The electrical contacts have mating ends that protrude from the top surface of the rigid board to mechanically engage and electrically connect to mating contacts of a mating electronic component.

In another embodiment, a connector system includes a mating electronic component and a rigid-flex circuit connector. The mating electronic component has a mating substrate that includes an array of contact pads along a bottom side of the mating substrate. The rigid-flex circuit connector electrically connects to the electronic component. The rigid-flex circuit connector includes a layered circuit board, an array of electrical contacts, and a frame assembly. The rigid-flex circuit connector electrically connects to the electronic component. The rigid-flex circuit connector includes a layered circuit board including a rigid portion and a flexible portion that extends from the rigid portion to a distal end of the flexible portion. The rigid portion includes a plurality of conductive vias extending into the rigid portion from a top surface of the rigid portion. The layered circuit board includes at least one conductive layer that is electrically connected to the conductive vias and that extends along the flexible portion to the distal end thereof. The array of electrical contacts is loaded in the conductive vias. The electrical contacts have mating ends that protrude from the top surface of the rigid portion. The frame assembly is mounted to a host board and holds the rigid portion of the layered circuit board. The flexible portion of the layered circuit board extends remote from the frame assembly. The frame assembly includes a cover plate that extends over the top surface of the rigid portion such that the rigid portion is disposed between the cover plate and the host board. The cover plate has a top side that engages the bottom side of the mating substrate. The cover plate defines at least one window that receives the array of electrical contacts therethrough for the electrical contacts to mechanically engage and electrically connect to the contact pads of the mating electronic component.

DETAILED DESCRIPTION OF THE INVENTION

One or more embodiments disclosed herein include a rigid-flex circuit connector for removably electrically connecting to a mating electronic component, such as a microprocessor. Instead of conventional connectors that include electrical contact-holding housings or sockets electrically connected to flex PCBs or the like via a ball grid array, the rigid-flex circuit connector eliminates the use of a ball grid array. For example, a rigid-flex PCB is used that includes at least one rigid or stiff board stacked with at least one flexible board. The rigid-flex PCB defines conductive (for example, plated) vias along a top of a rigid portion, and electrical contacts are inserted into the conductive vias. The electrical contacts in the vias are electrically connected to a conductive circuit of one of the flexible boards via the conductive vias. The flexible board of the rigid-flex PCB may extend beyond an edge of the one or more rigid boards to a remote location. The rigid-flex circuit connector may be used to convey high speed signals from the mating electronic component to the remote location through the electrical contacts and the rigid-flex PCB. The rigid-flex circuit may be used to convey the high speed signals in order to bypass the use of another circuit board, such as a motherboard, for transmitting such high speed signals.

Unlike the conventional connectors that rely on a ball grid array to electrically connect the electrical contacts (that mate to the mating electronic component) to the flex PCB for carrying a signal along a prescribed distance, the electrical contacts in the rigid-flex circuit connector described herein are directly loaded in and connected to the rigid-flex PCB via the conductive vias. By avoiding the use of a ball grid array, the rigid-flex circuit connector avoids the known manufacturing and signal integrity issues with ball grid arrays. For example, the rigid-flex circuit connector may have reduced manufacturing costs due to reduced complexity and easier assembly, such as by eliminating the difficult alignment and soldering step to form the ball grid array. The rigid-flex circuit connector may also have better signal integrity by avoiding the impedance discontinuity that may develop at the solder balls of the ball grid array.

Figure 1:
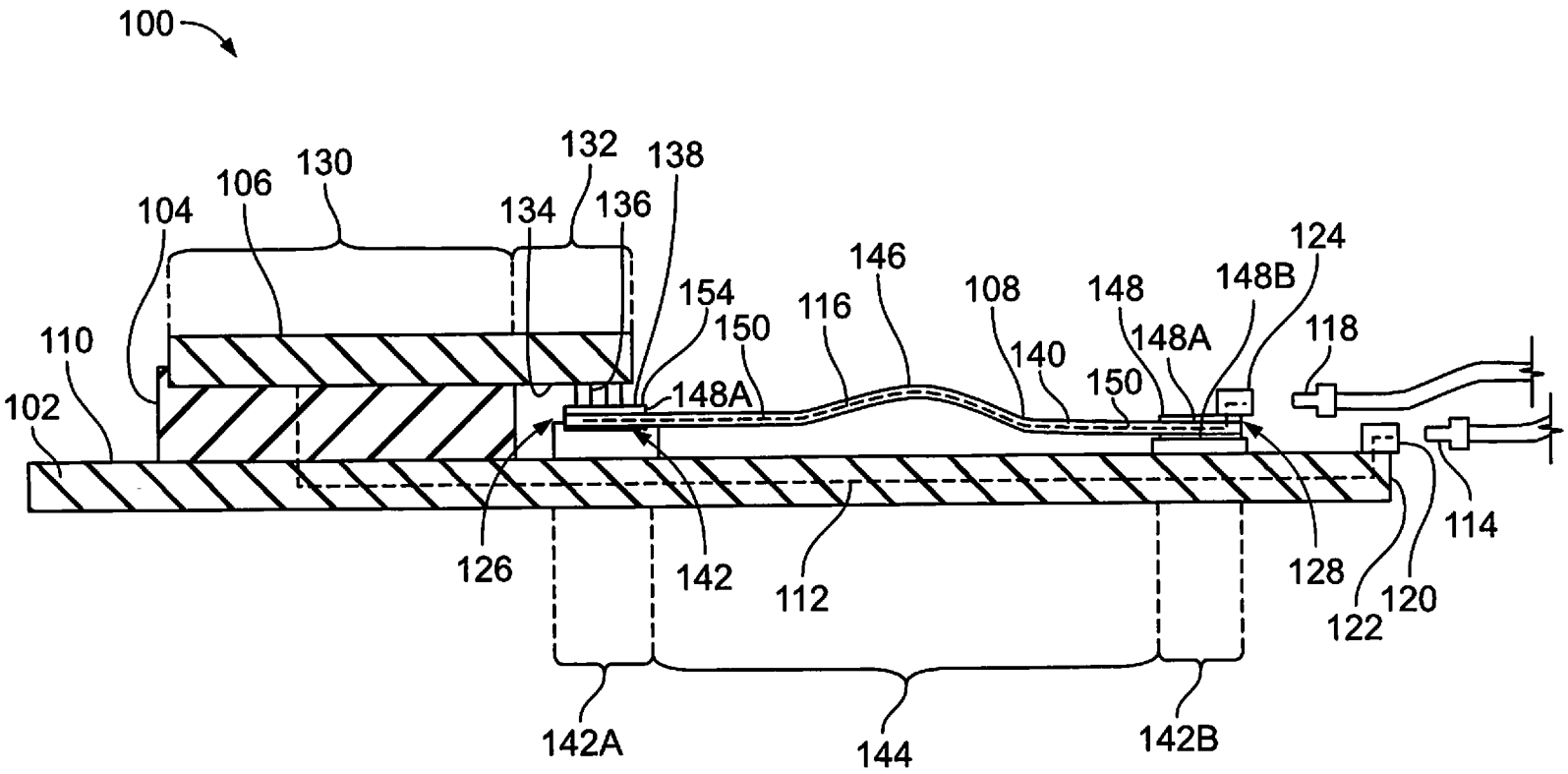
FIG. 1 is a schematic diagram showing an electrical connector system from the side according to an embodiment.

FIG. 1 is a schematic diagram showing a connector system 100 from the side according to an embodiment. Some of the components are shown in cross-section. The connector system 100 includes a host board 102, a socket housing 104, a mating electronic component 106, and a rigid-flex circuit connector 108. The host board 102 is a circuit board, such as a motherboard. The socket housing 104 and the rigid-flex circuit connector 108 are both mounted to a top surface 110 of the host board 102, although at spaced apart locations relative to one another. The mating electronic component 106 is mounted to the socket housing 104. Although not shown, the socket housing 104 includes electrically conductive elements that provide circuit paths between the mating electronic component 106 and the host board 102. In an embodiment, the mating electronic component 106 is a processing device, such as a microprocessor.

In the illustrated embodiment the connector system 100 is configured to send and/or receive electrical power and data signals between the mating electronic component 106 and two cable-mounted plug connectors. For example, the connector system 100 defines a first conductive signal path 112 between the mating electronic component 106 and a first plug connector 114, and the connector system 100 defines a second conductive signal path 116 between the mating electronic component 106 and a second plug connector 118. The plug connectors 114, 118 optionally may be input/output (I/O) transceivers. The first conductive signal path 112 extends from the mating electronic component 106 through the conductive elements of the socket housing 104 and along a conductive circuit (not shown) of the host board 102 to a first receptacle connector 120 at or proximate to an edge 122 of the host board 102. The first receptacle connector 120 is configured to mate with the first plug connector 114. In an embodiment, electrical power and low speed data signals are transmitted along the first conductive signal path 112. The low speed data signals as used herein may have a frequency of up to 1 Gbps or more. The low speed data signals are referred to as "low speed" relative to other, higher speed data signals transmitted to and/or from the mating electronic component 106.

The second conductive signal path 116 extends from the mating electronic component 106 through a conductive circuit of the rigid-flex circuit connector 108 to a second receptacle connector 124 configured to mate with the second plug connector 118. The rigid-flex circuit connector 108 extends longitudinally between a first end 126 and an opposite second end 128. The first end 126 is located at the mating electronic component 106, and the second receptacle connector 124 is mounted at or proximate to the second end 128, which is remote from the mating electronic component 106. As shown in FIG. 1, the second conductive signal path 116 is separate from the host board 102 such that signals transmitted along the second conductive signal path 116 do not pass through or along the host board 102. In an embodiment, high speed data signals are transmitted along the second conductive signal path 116. The high speed data signals may have frequencies of up to 10 Gbps, 20 Gbps, 30 Gbps, or more.

In an embodiment, the mating electronic component 106 includes a base portion 130 that engages the socket housing 104 and a platform portion 132 that extends from the base portion 130. The platform portion 132 projects beyond the socket housing 104 and electrically connects to the rigid-flex circuit connector 108. The base portion 130 of the mating electronic component 106 electrically connects to the socket housing 104, while the platform portion 132 electrically connects to the rigid-flex circuit connector 108. Therefore, power and low speed data signals may be transmitted to and from the base portion 130, and high speed data signals may be transmitted to and from the platform portion 132. A bottom side 134 of the mating electronic component 106 along the platform portion 132 includes an array of conductive mating contacts (not shown), such as contact pads. The mating contacts mechanically engage and electrically connect to electrical contacts 136 of the rigid-flex circuit connector 108.

The electrical contacts 136 project from a top side 138 of the rigid-flex circuit connector 108 to engage the mating contacts along the bottom side 134. The electrical contacts 136 are arranged in an array and located at or proximate to the first end 126 of the rigid-flex circuit connector 108. As used herein, relative or spatial terms such as "top," "bottom," "front," "rear," "left," and "right" are only used to distinguish the referenced elements and do not necessarily require particular positions or orientations in the connector system 100 or in the surrounding environment of the connector system 100.

In an embodiment, the rigid-flex circuit connector 108 includes the electrical contacts 136 and a layered circuit board 140. The layered circuit board 140 extends the length of the rigid-flex circuit connector 108 between the first and second ends 126, 128. The layered circuit board 140 defines at least one rigid portion 142 and at least one flexible portion 144 along the length. In the illustrated embodiment, a first rigid portion 142A is located at the first end 126, and a second rigid portion 142B is located at the second end 128. A single flexible portion 144 extends between the first and second rigid portions 142A, 142B.

The layered circuit board 140 includes at least one rigid board 148 stacked vertically relative to a flex board 150. In an embodiment, the rigid portions 142A, 142B include both the at least one rigid board 148 and the flex board 150, while the flexible portion 144 is defined by the flex board 150 only (without any rigid boards 148). Thus, the flex board 150 extends along the entire length of the layered circuit board 140, or at least a substantial majority of the length. Each rigid board 148 includes one or more rigid substrates such that the rigid portions 142A, 142B of the layered circuit board 140 are stiff, hard, and generally inflexible. The flex board 150 includes one or more flexible substrates and lacks rigid substrates, which allows the flexible portion 144 to bend, curl, and/or twist without breaking, as shown by the curve 146 along the middle segment of the flexible portion 144 in FIG. 1. In an embodiment, the rigid portions 142A, 142B each include an upper rigid board 148A stacked vertically above the flex board 150, such that the flex board 150 is disposed between the upper rigid boards 148A and the host board 102. The first rigid portion 142A and/or the second rigid portion 142B optionally includes a lower rigid board 148B stacked vertically below the flex board 150. The layered circuit board 140 is laminated such that the rigid boards 148A, 148B are fixed to the flex board 150.

In an exemplary embodiment, the first rigid portion 142A includes a plurality of conductive vias 152 (shown in FIG. 3) along the upper rigid board 148A such that the conductive vias 152 are open at a top surface 154 of the upper rigid board 148A. The electrical contacts 136 are loaded in the conductive vias 152 and protrude from the top surface 154 to mechanically engage and electrically connect to the mating contacts of the mating electronic component 106. The upper rigid board 148A defines a rigid board circuit 156 (shown in FIG. 3) that is electrically connected to a flex board circuit 158 (FIG. 3) of the flex board 150 within the layered circuit board 140. The conductive vias 152 are components of the rigid board circuit 156. Thus, the second conductive signal path 116 provided by the rigid-flex circuit connector 108 extends from the mating electronic component 106 through the electrical contacts 136, through the conductive vias 152 of the upper rigid board 148A, and through the flex board circuit 158 along the flex board 150 to the second receptacle connector 124. Optionally, the flex board circuit 158 of the flex board 150 is electrically connected to the second receptacle connector 124 via conductive vias 152 in the upper rigid board 148A of the second rigid portion 142B.

Figure 2:
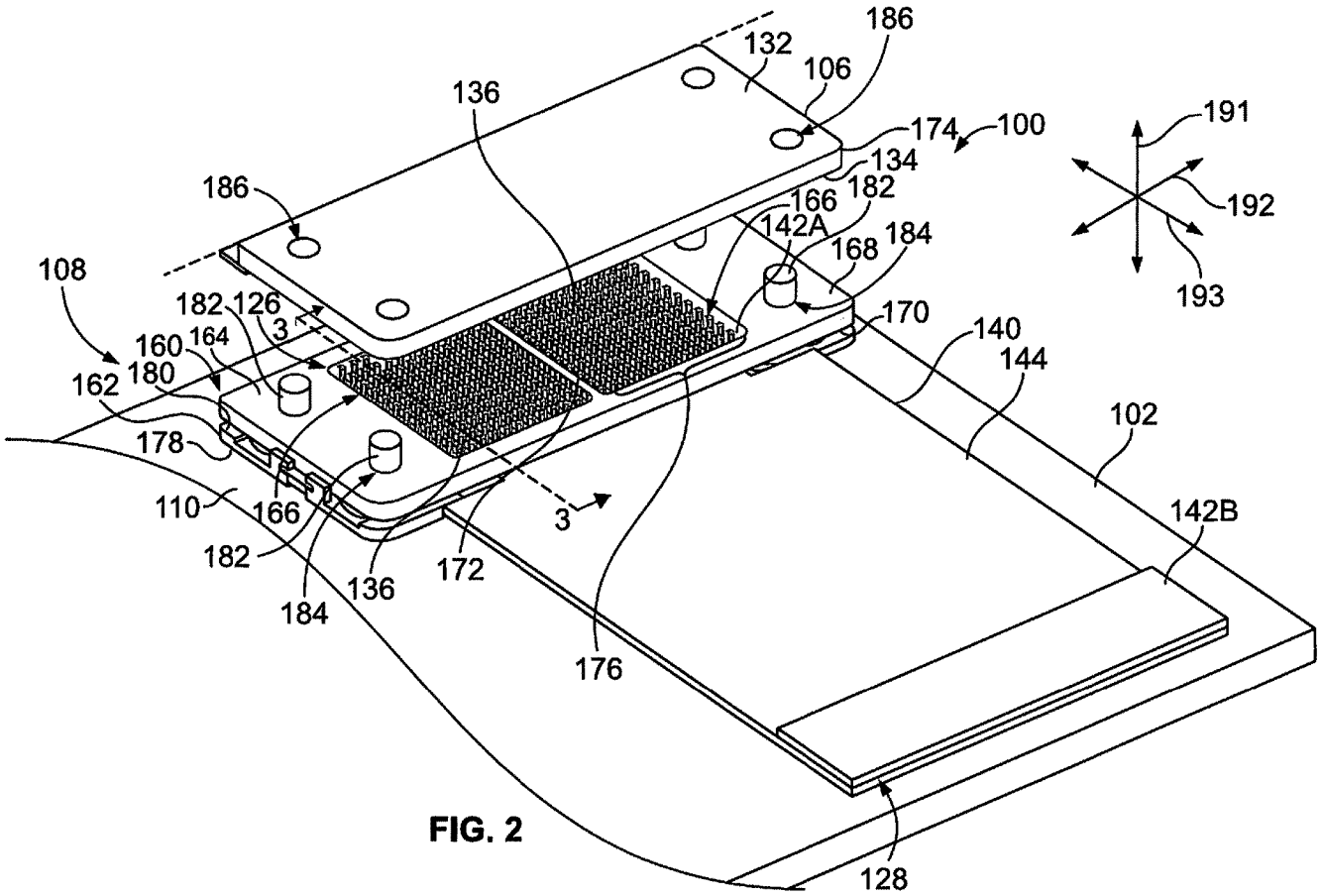
FIG. 2 is a top perspective view of a portion of the electrical connector system according to an embodiment.

FIG. 2 is a top perspective view of a portion of the connector system 100 according to an embodiment. In FIG. 2, the platform portion 132 of the mating electronic component 106 is illustrated, but the base portion 130 (shown in FIG. 1) of the mating electronic component 106 and the socket housing 104 (FIG. 1) are not shown. Furthermore, the first and second plug connectors 114, 118 and the first and second receptacle connectors 120, 124 that were shown in FIG. 1 are also omitted in FIG. 2. The connector system 100 is oriented with respect to a vertical or elevation axis 191, a lateral axis 192, and a longitudinal axis 193. The axes 191-193 are mutually perpendicular. Although the elevation axis 191 appears to extend in a vertical direction generally parallel to gravity, it is understood that the axes 191-193 are not required to have any particular orientation with respect to gravity.

The rigid-flex circuit connector 108 includes a frame assembly 160. The frame assembly 160 includes a base plate 162 and a cover plate 164. The base plate 162 is mounted to the host board 102. The cover plate 164 is coupled to the base plate 162. At least some of the first rigid portion 142A at the first end 126 of the layered circuit board 140 is held in the frame assembly 160 between the cover plate 164 and the host board 102. For example, the layered circuit board 140 may be secured to the host board 102 or to the base plate 162. The flexible portion 144 of the layered circuit board 140 extends from the rigid portion 142A and from the frame assembly 160 along the longitudinal axis 193 towards the second end 128. The second rigid portion 142B at the second end 128 is remote from the frame assembly 160.

The cover plate 164 is disposed vertically over the first rigid portion 142A (such as above the top surface 154 of the upper rigid board 148A shown in FIG. 1). The cover plate 164 defines at least one window 166 therethrough between a top side 168 and a bottom side 170 of the cover plate 164. In the illustrated embodiment, the cover plate 164 defines two adjacent windows 166 that are divided by a frame member 172. In other embodiments, the cover plate 164 may define a single window 166 or more than two windows 166. The top side 168 of the cover plate 164 is configured to engage the bottom side 134 of the mating electronic component 106. For example, as the mating electronic component 106 is lowered in a mating direction along the elevation axis 191 towards the rigid-flex circuit connector 108, the bottom side 134 of a mating substrate 174 of the mating electronic component 106 abuts the top side 168 of the cover plate 164.

The electrical contacts 136 of the rigid-flex circuit connector 108 are arranged in at least one array 176. Each array 176 of electrical contacts 136 is configured to extend, at least partially, through a corresponding window 166 of the cover plate 164. In the illustrated embodiment, the electrical contacts 136 are arranged in two arrays 176, such that the contacts in each array 176 commonly extend at least partially through one of the two windows 166 of the cover plate 164. The arrays 176 may have any number of electrical contacts 136, such as four electrical contacts 136. In one embodiment, the electrical contacts 136 extend fully through the corresponding window 166 such that ends of the contacts 136 align with or protrude beyond the top side 168 of the cover plate 164 to engage the mating contacts of the mating electronic component 106. For example, the mating contacts may be planar with the bottom side 134 of the mating electronic component 106 or may be recessed relative to the bottom side 134, such that the mating interface between the electrical contacts 136 and the mating contacts is above the top side 168 of the cover plate 164. In another embodiment, the electrical contacts 136 do not extend fully through the corresponding window 166 such that the ends of the contacts 136 are disposed below the top side 168. In such an embodiment, the mating contacts of the mating electronic component 106 may protrude from the bottom side 134 at least partially into the window 166 from above to engage the electrical contacts 136 below the top side 168 of the cover plate 164.

The base plate 162 includes a host side 178 and a cover side 180. The host side 178 of the base plate 162 abuts the top surface 110 of the host board 102. The cover side 180 is generally opposite to the host side 178 and faces the cover plate 164. In an embodiment, the base plate 162 is coupled to the cover plate 164 via mounting posts 182 of the base plate 162. The mounting posts 182 extend generally vertically from the cover side 180. Four mounting posts 182 are shown in FIG. 2, but the base plate 162 may include more or less than four mounting posts 182 in other embodiments. The cover plate 164 defines coupling apertures 184 that extend through the cover plate 164 between the top side 168 and the bottom side 170. The coupling apertures 184 each receive a corresponding one of the mounting posts 182 therein to align the cover plate 164 with the base plate 162 and couple the cover plate 164 to the base plate 162. Although not shown, one or more of the mounting posts 182 may receive a pin, a washer, a nut, or the like in order to secure the cover plate 164 on the mounting posts 182 by preventing the cover plate 164 from moving vertically off of the mounting posts 182.

In the illustrated embodiment, the mating substrate 174 of the mating electronic component 106 defines at least one datum hole 186. The datum holes 186 extend at least partially through the mating substrate 174 from the bottom side 134 upwards. In the illustrated embodiment, the mating substrate 174 defines four datum holes 186 that extend fully through the mating substrate 174. The datum holes 186 are configured to receive the mounting posts 182 therein as the mating electronic component 106 is loaded onto the frame assembly 160 in order to align the mating contacts with the array(s) 176 of electrical contacts 136. For example, the base plate 162 may be positioned specifically relative to the rigid portion 142A of the layered circuit board 140, and the electrical contacts 136 loaded on the rigid portion 142A. As the mounting posts 182 of the base plate 162 are received in the corresponding datum holes 186 of the mating substrate 174, the mating substrate is specifically located relative to the rigid portion 142A such that the mating contacts align with the electrical contacts 136 of the rigid portion 142A.

Figure 3:
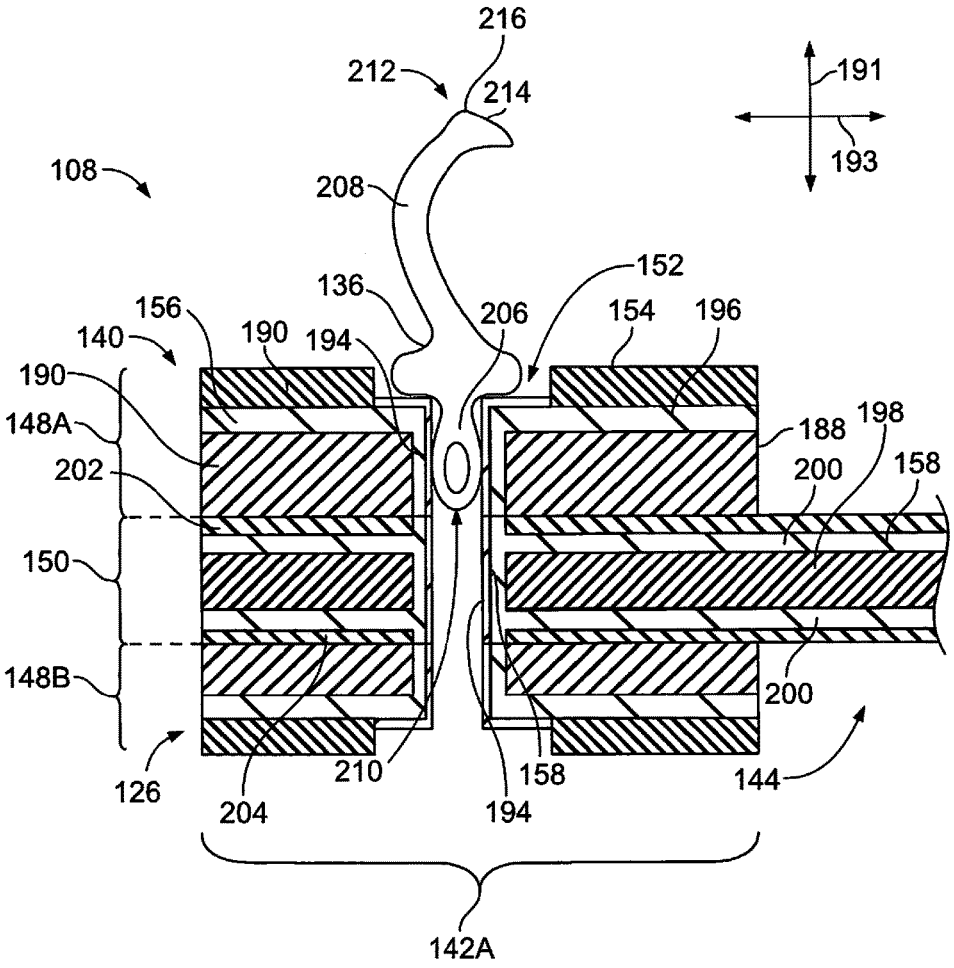
FIG. 3 is a schematic cross-section of a section of a rigid-flex circuit connector of the connector system along line 3-3 shown in FIG. 2.

FIG. 3 is a schematic cross-section of a section of the rigid-flex circuit connector 108 along the line 3-3 shown in FIG. 2. The section shown in FIG. 3 includes the first rigid portion 142A and part of the flexible portion 144 of the layered circuit board 140. The rigid portion 142A includes the flex board 150 stacked vertically (along the elevation axis 191) between the upper and lower rigid boards 148A, 148B. The flex board 150 has a longer length (along the longitudinal axis 193) than the upper rigid board 148A (and the lower rigid board 148B) such that a segment of the flex board 150 extends beyond an interior edge 188 of the rigid board 148A along the flexible portion 144 of the layered circuit board 140. In the illustrated embodiment, the flex board 150 and both rigid boards 148A, 148B align with each other at the first end 126 of the rigid-flex circuit connector 108. But, in one or more alternative embodiments, the first end 126 is not defined by all of the boards 148A, 148B, 150. For example, the flex board 150 may not extend all of the way to the first end 126, such that the first end 126 is defined by one or both of the rigid boards 148A, 148B. Although the rigid portion 142A shown in FIG. 3 includes a stack of two rigid boards 148A, 148B sandwiching a single flex board 150, the rigid portion 142A in an alternative embodiment may include only the upper rigid board 148A and the flex board 150, without the lower rigid board 148B. In another alternative embodiment, the rigid portion 142A may include a stack of more than one flex board 150 and/or more than two rigid boards 148A, 148B.

The upper rigid board 148A includes at least one rigid substrate 190 and the rigid board circuit 156. The rigid substrate 190 is composed of an electrically insulative dielectric material, such as FR-4 or another type of silica epoxy. The rigid board circuit 156 includes the conductive vias 152. The conductive vias 152 extend into the rigid board 148A from the top surface 154. The rigid board circuit 156 optionally also includes at least one conductive layer 196 that extends generally parallel to the at least one rigid substrate 190 along the longitudinal axis 193. The conductive layer 196 may be copper or another conductive metal material. The conductive layer 196 may include conductive traces. In an embodiment, at least some of the conductive vias 152 extend fully through the upper rigid board 148A, including through the at least one rigid substrate 190 and through the at least one conductive layer 196. The conductive via 152 in the illustrated embodiment extends fully through the entire stack, passing through both rigid boards 148A, 148B and the flex board 150 therebetween. The conductive via 152 includes metal side walls 194 that extend vertically and at least partially define the vias 152. The conductive via 152 may be referred to as a plated via.

The flex board 150 includes at least one flexible substrate 198 and the flex board circuit 158. The flexible substrate 198 is an electrically insulative material, such as polyimide or another flexible polymer. The flex board circuit 158 includes at least one conductive layer 200 that extends longitudinally along the flexible substrate 198. The flex board circuit 158 shows two conductive layers 200 in the illustrated embodiment. The conductive layers 200 extend the length of the flex board 150 from the rigid portion 142A along the flexible portion 144 to a distal end of the flex board 150 at or proximate to the second end 128 (shown in FIG. 2) of the layered circuit board 140.

The flex board 150 is secured to the rigid board 148A via an adhesive layer 202 that is stacked between the rigid board 148A and the flex board 150. Another adhesive layer 204 is stacked between the flex board 150 and the lower rigid board 148B to secure the flex board 150 to the lower rigid board 148B. The adhesive layers 202, 204 may be heat- or pressure-activated adhesives that fuse the flex board 150 to the respective rigid boards 148A, 148B. For example, the layered circuit board 140 may be formed by laminating the flex board 150 between the rigid boards 148A, 148B using heat, pressure, welding, or purely by the adhesive layers 202, 204 without heat or pressure.

The flex board circuit 158 is electrically connected to the rigid board circuit 156 of the upper rigid board 148A. For example, in the illustrated embodiment, the conductive via 152 of the rigid board circuit 156 extends through the flex board 150 and electrically connects to one or both of the conductive layers 200 of the flex board circuit 158. The metal side walls 194 of the conductive via 152 mechanically engage the conductive layer(s) 200. The conductive via 152 in the illustrated embodiment is a conductive thru-hole (or through-hole) that extends fully through the layered circuit board 140. The conductive vias extend between the conductive layer 196 of the rigid board circuit 156 and at least one of the conductive layers 200 of the flex board circuit 158 to electrically connect the conductive layer 196 to the conductive layer(s) 200. Therefore, in the illustrated embodiment, the flex board circuit 158 is electrically connected to the rigid board circuit 156 through direct engagement between the metal side walls 194 of the conductive via 152 of the rigid board circuit 156 and one or both of the conductive layers 200 of the flex board circuit 158.

In an alternative embodiment, instead of or in addition to the thru-hole 152 shown in FIG. 3, the rigid board circuit 156 may include at least one blind via that is open at the top surface 154 and extends through the upper rigid board 148A, but does not extend through the flex board 150. For example, in such alternative embodiment the blind via may be electrically connected to a conductive layer 196 of the upper rigid board 148A, and the conductive layer 196 may be electrically connected to one or more buried vias that are spaced apart from the blind via. The buried vias may extend through the flex board 150 and electrically connect to at least one of the conductive layers 200 thereof. Thus, the flex board circuit 158 may be electrically connected to the rigid board circuit 156 along a conductive path that extends from the blind via of the rigid board circuit 156 along a length of the conductive layer 196 and through one or more buried vias to the conductive layer 200 of the flex board circuit 158.

One of the electrical contacts 136 is loaded in the conductive via 152. The electrical contact 136 extends between a terminating end 210 and a mating end 212. The electrical contact 136 has a unitary structure formed by one or more metals. The electrical contact 136 includes a pin 206 that extends to the terminating end 210 and is received in the conductive via 152. The pin 206 engages the metal side walls 194 of the conductive via 152. The pin 206 is a compliant eye-of-the-needle pin in the illustrated embodiment. The electrical contact 136 may be retained in the conductive via 152 by an interference fit between the compliant pin 206 and the side walls 194. Optionally, the electrical contact 136 may also be soldered to the conductive via 152 to more permanently secure the contact 136 to the layered circuit board 140. For example, a solder material may be applied along the opening of the conductive via 152 after the electrical contact 136 is loaded into the conductive via 152.

The electrical contact 136 further includes a deflectable arm 208 that extends from the conductive via 152 beyond the top surface 154 of the upper rigid board 148A to the mating end 212. The deflectable arm 208 may have a hooked contour. The deflectable arm 208 includes an engagement area 214 that is configured to mechanically engage a corresponding mating contact of the mating electronic component 106 (shown in FIG. 2). The engagement area 214 is a protrusion 216 in the illustrated embodiment. The protrusion 216 is curved and is configured to engage a planar contact pad of the mating electronic component 106 without catching on or scratching the contact pad. The deflectable arm 208 is resiliently deflectable such that the arm 208 bends or compresses at least partially towards the upper rigid board 148A upon the mating contact engaging the engagement area 214 of the deflectable arm 208. The deflection of the arm 208 biases the arm 208 into sustained contact between the engagement area 214 and the mating contact.

As shown in FIG. 3, the conductive signal path 116 (shown in FIG. 1) through the rigid-flex circuit connector 108 extends through the electrical contacts 136 and through the layered circuit board 140 to a remote device or connector (for example, the I/O receptacle 124 shown in FIG. 1), and not through the host board 102 (FIG. 1). For example, a first segment of the path 116 extends from the engagement area 214 of the deflectable arm 208 of each contact 136 through the electrical contact 136 to the pin 206. The pin 206 is electrically connected to the conductive via 152. A second segment of the path 116 extends from the conductive via 152 of the rigid board circuit 156 directly or indirectly to at least one of the conductive layers 200 of the flex board circuit 158. The second segment of the path 116 further extends along the conductive layer 200 from the rigid portion 142A into and along the flexible portion 144 towards the remote device or connector at the second end 128 (shown in FIG. 2) of the layered circuit board 140. By routing the electrical signals directly from the electrical contacts 136 to the board circuits 156, 158 of the layered circuit board 140, the use of a ball grid array is avoided. Thus, the conductive signal path 116 may enhance signal integrity performance (for example, by avoiding impedance discontinuities) and reduce manufacturing issues (for example, costs, complexity, and additional steps) associated with conventional routing schemes.

Figure 4:
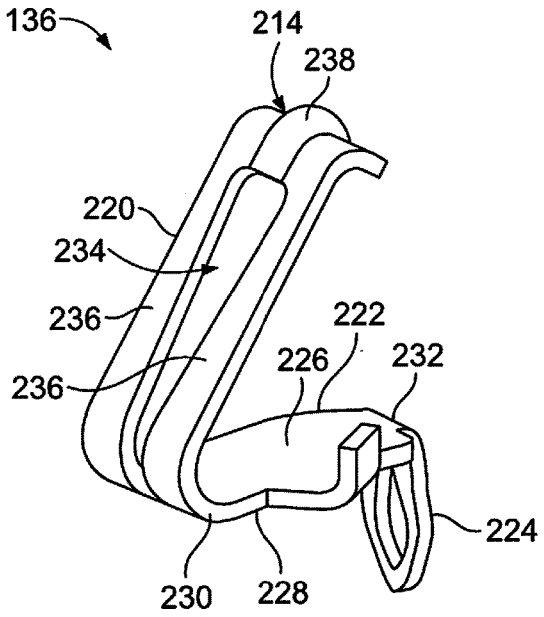
FIG. 4 is a perspective view of an electrical contact of the rigid-flex circuit connector according to an embodiment.

FIG. 4 is a perspective view of one of the electrical contacts 136 of the rigid-flex circuit connector 108 according to an embodiment. The electrical contact 136 includes a deflectable arm 220, a planar base segment 222, and a pin 224. The pin 224 is a compliant eye-of-the-needle pin, like the pin 206 shown in FIG. 3. The base segment 222 has a top face 226 and an opposite bottom face 228. The base segment 222 further includes a first end 230 and an opposite second end 232. The deflectable arm 220 is connected to the first end 230 of the base segment 222 and extends above the top face 226. The pin 224 is connected to the second end 232 of the base segment 222 and extends below the bottom face 228. The bottom face 228 of the base segment 222 may abut the top surface 154 (shown in FIG. 3) of the upper rigid board 148A (FIG. 3) when the pin 224 is loaded in the corresponding conductive via 152 (FIG. 3). Optionally, an adhesive or a solder material may be applied to the bottom face 228 to secure the base segment 222 to the upper rigid board 148A. Alternatively, an adhesive or solder material may be applied to the top face 226 after the contact 136 is loaded in the via 152, such that the adhesive or solder material extends beyond edges of the base segment 222 to hold the base segment 222 against the upper rigid board 148A.

The deflectable arm 220 has a split-beam structure with an opening 234 between two beams 236, which may support the compliance and resilience of the deflectable arm 220. The deflectable arm 220 includes a curved protrusion 238 at the engagement area 214 that is configured to engage a planar contact pad of the mating electronic component 106 (shown in FIG. 2) without catching on or scratching the contact pad. The electrical contact 136 may be stamped and formed out of a single sheet of metal, such as a copper alloy. The protrusion 238 optionally may be plated in a different metal or metal alloy than the rest of the contact 136, such as gold.

Figure 5:
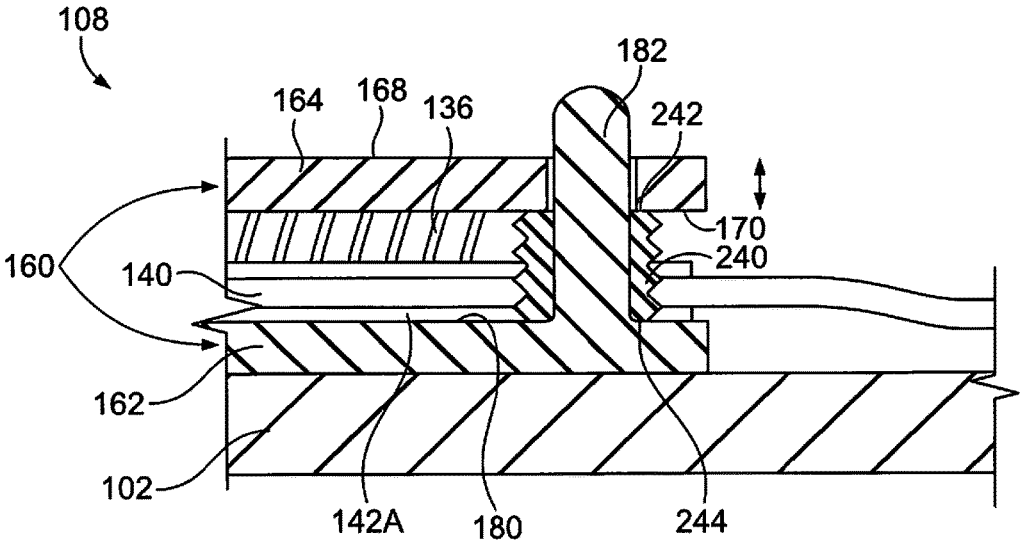
FIG. 5 is a cross-sectional side view of a portion of the rigid-flex circuit connector according to an embodiment.

FIG. 5 is a cross-sectional side view of a portion of the rigid-flex circuit connector 108 according to an embodiment. The illustrated portion shows a portion of the frame assembly 160. The base plate 162 is mounted to the host board 102. The rigid portion 142A of the layered circuit board 140 is fixed to the base plate 162, such as via an adhesive, a fastener, or through a friction fit provided by a clamp or the like. Alternatively, the rigid portion 142A may be secured directly to the host board 102. One of the mounting posts 182 of the base plate 162 extends vertically from the cover side 180 of the base plate 162. The mounting post 182 does not extend through the layered circuit board 140, which is spaced apart laterally from the mounting post 182 (for example, the layered circuit board 140 is disposed behind the mounting post 182). The cover plate 164 is loaded on the mounting post 182. The mating electronic component 106 (shown in FIG. 2) is not shown in FIG. 5, although the top side 168 of the cover plate 164 is configured to abut the mating electronic component 106.

In an embodiment, the frame assembly 160 includes at least one spring member 240 between the base plate 162 and the cover plate 164 such that the cover plate 164 is spring-biased and movable relative to the base plate 162 and the layered circuit board 140. In the illustrated embodiment a spring member 240 surrounds the mounting post 182. The spring member 240 may be a coiled compression spring, a compressible gasket, bearing, or bushing, or the like. One end 242 of the spring member 240 engages the bottom side 170 of the cover plate 164, and the other end 244 of the spring member 240 engages the cover side 180 of the base plate 162. The spring member 240 allows the cover plate 164 to float relative to the electrical contacts 136 on the layered circuit board 140, which are fixed in place. The floating cover plate 164 allows the mating electronic component 106 (shown in FIG. 2) to have a variable height relative to the electrical contacts 136, which compensates for contact height variation caused by tolerance mismatches in the frame assembly 160. The spring member 240 may provide a hard stop that restricts the cover plate 164 from being pressed towards the base plate 162 to an extent that risks damaging the electrical contacts 136. For example, the spring member 240 may prohibit the mating electronic component 106 from over-deflecting the contacts 136 by preventing the cover plate 164 from entering a threshold proximity of the base plate 162.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A rigid-flex circuit connector comprising:

a layered circuit board having a rigid board stacked above a flex board, the rigid board including at least one rigid substrate and a rigid board circuit, the rigid board circuit including a plurality of conductive vias extending into the rigid board from a top surface of the rigid board, the flex board including at least one flexible substrate and a flex board circuit, the flex board circuit electrically connected to the conductive vias of the rigid board circuit; and an array of electrical contacts loaded in the conductive vias, the electrical contacts having mating ends protruding from the top surface of the rigid board to mechanically engage and electrically connect to mating contacts of a mating electronic component.

2. The rigid-flex circuit connector of claim 1, wherein the layered circuit board includes a rigid portion and a flexible portion extending from the rigid portion, the rigid portion including both the rigid board and the flex board, the flexible portion including the flex board and not the rigid board.

3. The rigid-flex circuit connector of claim 1, wherein the flex board has a longer length than the rigid board such that a segment of the flex board extends beyond an edge of the rigid board.

4. The rigid-flex circuit connector of claim 3, wherein the flex board circuit includes a conductive layer that extends along a length of the flex board beyond the edge of the rigid board to a distal end of the flex board, the conductive vias of the rigid board circuit including metal side walls that extend through and electrically connect to the conductive layer of the flex board circuit, the rigid-flex circuit connector providing electrical circuit paths that extend through the electrical contacts, through the conductive vias of the rigid board, and along the conductive layer to the distal end of the flex board.

5. The rigid-flex circuit connector of claim 1, further comprising a frame assembly, the frame assembly including a base plate configured to be mounted to a host board and a cover plate coupled to the base plate, at least a portion of the layered circuit board being held in the frame assembly between the cover plate and the base plate, the cover plate defining at least one window therethrough between a top side and a bottom side of the cover plate, the top side configured to engage the mating electronic component, the mating ends of the electrical contacts extending through the at least one window to engage the mating contacts of the mating electronic component.

6. The rigid-flex circuit connector of claim 5, wherein the mating ends of at least four electrical contacts extend through the at least one window of the cover plate.

7. The rigid-flex circuit connector of claim 5, wherein the base plate has a host side and a cover side, the base plate including multiple mounting posts extending from the cover side of the base plate, the cover plate defining coupling apertures that receive the mounting posts therein to couple the cover plate to the base plate, the mounting posts further configured to be received within datum holes of the mating electronic component to align the mating electronic component relative to the array of electrical contacts of the layered circuit board.

8. The rigid-flex circuit connector of claim 5, wherein at least a portion of the layered circuit board is fixed to at least one of the host board or the base plate, the frame assembly including spring members between the base plate and the cover plate such that the cover plate is spring-biased against the mating electronic component and movable relative to the base plate and the layered circuit board.

9. The rigid-flex circuit connector of claim 1, wherein the rigid board of the layered circuit board is a first rigid board, the layered circuit board further including a second rigid board, the flex board stacked vertically between the first and second rigid boards.

10. The rigid-flex circuit connector of claim 1, wherein at least some of the electrical contacts include a pin that is received in the corresponding conductive via of the layered circuit board and a deflectable arm that extends beyond the top surface of the rigid board to the mating end, the deflectable arm including an engagement area configured to engage contact pads of the mating contacts of the mating electronic component.

11. The rigid-flex circuit connector of claim 10, wherein the at least some of the electrical contacts further include a planar base segment having a top face and an opposite bottom face, the base segment further including a first end and an opposite second end, the deflectable arm being connected to the first end of the base segment and extending above the top face thereof to the mating end, the pin being connected to the second end of the base segment and extending below the bottom face thereof.

12. The rigid-flex circuit connector of claim 1, wherein the layered circuit board includes an adhesive layer stacked between the rigid board and the flex board to secure the rigid board to the flex board.

13. The rigid-flex circuit connector of claim 1, wherein the layered circuit board is configured to convey high speed data signals from the mating electronic component.

14. A rigid-flex circuit connector comprising:

a layered circuit board having a rigid portion and a flexible portion extending from the rigid portion to a distal end, the layered circuit board including a rigid board stacked above a flex board, the rigid portion including both the rigid board and the flex board, the flexible portion including the flex board and not the rigid board, the flex board including at least one flexible substrate and a flex board circuit, the flex board circuit including a conductive layer that extends from the rigid portion along the flexible portion towards the distal end, the rigid board including at least one rigid substrate and a rigid board circuit, the rigid board circuit including a plurality of conductive vias extending into the rigid board from a top surface of the rigid board, the conductive vias electrically connecting to the conductive layer of the flex board circuit; and an array of electrical contacts loaded in the conductive vias, the electrical contacts having mating ends protruding from the top surface of the rigid board to mechanically engage and electrically connect to mating contacts of a mating electronic component.

15. The rigid-flex circuit connector of claim 14, wherein at least some of the electrical contacts include a pin that is received in the corresponding conductive via of the rigid board and a deflectable arm that extends beyond the top surface of the rigid board to the mating end to engage the mating contacts of the mating electronic component.

16. The rigid-flex circuit connector of claim 14, further comprising a frame assembly, the frame assembly including a base plate configured to be mounted to a host board and a cover plate coupled to the base plate, the rigid portion of the layered circuit board being held in the frame assembly between the cover plate and the base plate, the flexible portion extending from the frame assembly, the cover plate defining at least one window therethrough between a top side and a bottom side of the cover plate, the top side configured to engage the mating electronic component, the mating ends of the electrical contacts extending through the at least one window to engage the mating contacts of the mating electronic component.

17. The rigid-flex circuit connector of claim 14, wherein at least some of the conductive vias extend fully through the rigid board and at least partially through the flex board stacked below the rigid board, the at least some of the conductive vias including metal side walls that engage and electrically connect to the conductive layer of the flex board circuit.

18. A connector system comprising:

a mating electronic component having a mating substrate that includes an array of contact pads along a bottom side of the mating substrate; and a rigid-flex circuit connector that electrically connects to the electronic component, the rigid-flex circuit connector comprising:

a layered circuit board including a rigid portion and a flexible portion that extends from the rigid portion to a distal end of the flexible portion, the rigid portion including a plurality of conductive vias extending into the rigid portion from a top surface of the rigid portion, the layered circuit board including at least one conductive layer that is electrically connected to the conductive vias and that extends along the flexible portion to the distal end thereof;

an array of electrical contacts loaded in the conductive vias, the electrical contacts having mating ends protruding from the top surface of the rigid portion; and a frame assembly mounted to a host board and holding the rigid portion of the layered circuit board, the flexible portion of the layered circuit board extending remote from the frame assembly, the frame assembly including a cover plate that extends over the top surface of the rigid portion such that the rigid portion is disposed between the cover plate and the host board, the cover plate having a top side that engages the bottom side of the mating substrate, the cover plate defining at least one window that receives the array of electrical contacts therethrough for the electrical contacts to mechanically engage and electrically connect to the contact pads of the mating electronic component.

19. The connector system of claim 18, wherein the electronic component is a microprocessor.

20. The connector system of claim 18, wherein the frame assembly further includes a base plate having a host side that abuts the host board and a cover side opposite the host side, the base plate including multiple mounting posts extending from the cover side, the cover plate defining coupling apertures that receive the mounting posts therein to couple the cover plate to the base plate, the mating substrate of the mating electronic component defining datum holes that receive the mounting posts therein to align the mating electronic component relative to the array of electrical contacts.

* * * * *